US007131920B2

(12) United States Patent
Ashino

(10) Patent No.: US 7,131,920 B2
(45) Date of Patent: Nov. 7, 2006

(54) RACKET FRAME

(75) Inventor: Takeshi Ashino, Hyogo (JP)

(73) Assignee: SRI Sports Limited, Kobe (JP)

( * ) Notice: Subject to any disclaimer, the term of this patent is extended or adjusted under 35 U.S.C. 154(b) by 136 days.

(21) Appl. No.: 10/958,497

(22) Filed: Oct. 6, 2004

(65) Prior Publication Data

US 2005/0119075 A1 Jun. 2, 2005

(30) Foreign Application Priority Data

Nov. 27, 2003 (JP) ..... 2003-396800
May 21, 2004 (JP) ..... 2004-152515

(51) Int. Cl.
*A63B 49/10* (2006.01)

(52) U.S. Cl. ..... 473/535; 473/536; 473/537; 473/521

(58) Field of Classification Search ..... 473/524, 473/535–537, 520–521
See application file for complete search history.

(56) References Cited

U.S. PATENT DOCUMENTS 4,770,929 A * 9/1988 Nobumasa et al. ..... 442/278
5,487,928 A * 1/1996 Fujimoto ..... 442/175
5,965,249 A * 10/1999 Sutton et al. ..... 428/304.4
6,335,100 B1 1/2002 Tominaga et al.
2003/0064838 A1* 4/2003 Ashino et al. ..... 473/535
2005/0003912 A1* 1/2005 Ashino et al. ..... 473/535
2005/0119075 A1* 6/2005 Ashino ..... 473/535

FOREIGN PATENT DOCUMENTS

JP 61-29613 B2 7/1986
JP 5-33645 A 5/1993
JP 10-290851 A 11/1998
JP 2002-45444 A 2/2002
JP 2005-27887 * 2/2005
JP 2005-177442 * 7/2005

* cited by examiner

*Primary Examiner*—Raleigh W. Chiu
(74) *Attorney, Agent, or Firm*—Birch, Stewart, Kolasch and Birch, LLP

(57) ABSTRACT

A racket frame including a first laminate composed of a plurality of first prepregs consisting of fiber reinforced resin and a second prepreg, consisting of fiber reinforced resin, which is layered on the first laminate. The first laminate has a loss factor (=tan δ) set to not less than 0.005 nor more than 0.02, when the loss factor is measured at a temperature of 10° C. and a frequency of 10 Hz. The second prepreg has a loss factor (=tan δ) set to not less than 0.10 nor more than 0.50, when the loss factor is measured at a temperature of 10° C. and a frequency of 10 Hz.

10 Claims, 7 Drawing Sheets

( ⟶ hit with impact hammer )

RACKET FRAME

This nonprovisional application claims priority under 35 U.S.C. § 119(a) on patent application No(s). 2003-396800 filed in Japan on Nov. 27, 2003 and 2004-152515 filed in Japan on May 21, 2004, the entire contents of which are hereby incorporated by reference.

BACKGROUND OF THE INVENTION

1. Field of the Invention

The present invention relates to a racket frame and more particularly to a racket frame composed of a laminate of prepregs consisting of fiber reinforced resin. The racket frame of the present invention is intended to have a high vibration-damping performance without deteriorating the strength and rigidity thereof, although the racket frame is lightweight.

2. Description of the Related Art

In playing tennis, vibrations generated on a racket when a player hits a tennis ball therewith and shocks applied to the player's hand make the player uncomfortable and are considered to be a cause for tennis elbow. Therefore various devices have been made to suppress vibrations generated when the player hits the tennis ball. In a representative vibration-suppressing method, thermoplastic resins having a high vibration-damping performance are used as the matrix resin of the fiber reinforced resin composing the racket frame.

For example, in the racket proposed by the present applicant and disclosed in Japanese Patent Publication No. 5-33645 (patent document 1), the thermoplastic resin consisting of the nylon resin having a high vibration-damping performance is used as the matrix resin. According to the disclosure, the vibration-damping ratio of this racket is about twice as high as that of a racket whose frame contains a thermosetting resin (for example, epoxy resin) as its matrix resin, supposing that the volume ratio of the fiber reinforcing the thermoplastic resin is equal to that of the fiber reinforcing the thermosetting resin.

As disclosed in Japanese Patent Application Laid-Open No. 10-290851 (patent document 2), the present applicant also proposed the racket frame composed of the epoxy resinous composition containing the rubber-like polymeric component and the (meta) acrylic polymeric fine particles in a dispersed state. The racket frame has an improved vibration-damping performance without deteriorating its rigidity and strength and has a low degree of fluctuations in its vibration-damping performance.

As disclosed in Japanese Patent Publication No. 61-29613 (patent document 3), there is disclosed the prepreg containing the rubber-modified epoxy resin, having a sea-island structure, as its matrix resin. The epoxy resin and the liquid rubber compatible with the epoxy resin are hardened by uniformly compatibilizing the epoxy resin and the liquid rubber with each other.

As disclosed in Japanese Patent Application Laid-Open No. 2002-45444 (patent document 4), the present applicant also proposed a racket frame having the viscoelastic material disposed at one or more positions of the layer of fiber reinforced resin as the vibration-absorbing material. The viscoelastic material has a loss factor (=tan δ) not less than 1.00 and a thickness not less than 0.1 mm nor more than 0.6 mm, when the loss factor is measured at a temperature of 6° C. and a frequency of 10 Hz.

In the racket disclosed in Japanese Patent Publication No. 5-33645, the reason the nylon resin serving as the matrix resin has excellent vibration-damping performance is because water serves as a plasticizer and the glass transition temperature drops greatly. The glass transition temperature is about 60 degrees in an absolute dry state, but drops as the water absorption increases. Thus the glass transition temperature becomes about 20 degrees in the vicinity of the room temperature when the water absorption becomes 3%. Therefore the vibration-damping ratio of the racket is 0.005 in the absolute dry state, but 0.020 when the water absorption is saturated. That is, when a humidity changes, the performance of the racket changes. Thus although the vibration-damping performance of the racket can be enhanced, there is room for improvement in the degree of dependence on environment and in making its weight lightweight.

In the racket frame disclosed in Japanese Patent Application Laid-Open No. 10-290851, although the racket frame has an excellent vibration-damping performance, the epoxy resinous composition containing the rubber-like polymeric component and the (meta) acrylic polymeric fine particles in a dispersed state has a high viscosity. Thus it is frequently difficult to mold the epoxy resinous composition. Further there is still room for improvement in making the weight of the racket frame lightweight and efficient realization of its vibration-damping performance.

Although the prepreg disclosed in Japanese Patent Publication No. 61-29613 has a high self-adhesion, the prepreg is incapable of enhancing the vibration-damping performance of the racket efficiently by making the racket lightweight and durable.

In the racket frame disclosed in Japanese Patent Application Laid-Open No. 2002-45444, the rigidity of the racket frame may deteriorate owing to the influence of the viscoelastic material partly interposed between the adjacent fiber reinforced resins, which leads to deterioration of the restitution coefficient of the racket frame. Thus this racket frame is demanded to improve its rigidity, strength, and vibration-damping performance in a favorable balance without increasing its weight.

SUMMARY OF THE INVENTION

The present invention has been made in view of the above-described problems. Therefore, it is an object of the present invention to provide a racket frame allowed to be lightweight without deteriorating its rigidity and strength and have an excellent vibration-damping performance.

To achieve the object, the racket frame of the present invention includes a first laminate composed of a plurality of first prepregs consisting of fiber reinforced resin and a second prepreg, consisting of fiber reinforced resin, which is layered on the first laminate. The first laminate has a loss factor (=tan δ) set to not less than 0.005 nor more than 0.02, when the loss factor is measured at a temperature of 10° C. and a frequency of 10 Hz. The second prepreg has a loss factor (=tan δ) set to not less than 0.10 nor more than 0.50, when the loss factor is measured at a temperature of 10° C. and a frequency of 10 Hz.

The loss factor (=tan δ) of the first laminate composed of a plurality of the first prepregs is measured after the first prepregs are hardened.

The loss factor of the first laminate and that of the second prepreg layered on the first laminate are different from each other. Therefore it is possible to maintain the strength and rigidity of the racket frame owing to the use of the first laminate having the lower loss factor and enhance the vibration-damping performance thereof efficiently owing to the use of the second prepreg having the higher loss factor.

Further since the second prepreg whose loss factor is appropriately adjusted is capable of improving the vibration-damping performance of the racket frame without disposing other materials such as a vibration-damping material in a layer of fiber reinforced resin. Therefore it is possible to prevent an increase of the weight of the racket frame. That is, it is possible to keep the racket frame lightweight.

One second prepreg can be used. Instead a plurality of the second prepregs may be layered on the first laminate.

The first laminate has a loss factor (=tan δ) set to not less than 0.005 nor more than 0.02, when the loss factor is measured at a temperature of 10° C. and a frequency of 10 Hz.

If the loss factor of the first laminate is less than 0.005, the vibration-damping performance of the racket frame deteriorates. The loss factor of the first laminate is set to favorably not less than 0.007 and more favorably not less than 0.010. On the other hand, if the loss factor of the first laminate is more than 0.02, the strength of the racket frame deteriorates. The loss factor of the first laminate is set to favorably not more than 0.018 and more favorably not more than 0.015.

The second prepreg has a loss factor (=tan δ) set to not less than 0.10 nor more than 0.50, when the loss factor is measured at a temperature of 10° C. and a frequency of 10 Hz.

If the loss factor of the second prepreg is less than 0.10, the vibration-damping performance of the racket frame deteriorates. The loss factor of the second prepreg is set to favorably not less than 0.20 and more favorably not less than 0.30. On the other hand, if the loss factor of the second prepreg is set to more than 0.50, the strength of the racket frame deteriorates. The loss factor of the second prepreg is set to favorably not more than 0.45 and more favorably not more than 0.4.

The loss factor (=tan δ) of the first laminate is measured by a viscosity measuring apparatus (manufactured by Rheology Inc). The loss factor (=tan δ) is measured in a flexing mode and under the following conditions: a frequency of 10 Hz, a temperature of 10° C., a temperature increase of 4° C., and a displacement amplitude of ±50μ. A specimen used for the measurement is a laminate composed of nine layers of prepregs disposed one upon another, with reinforcing fibers of adjacent prepregs intersecting perpendicularly to each other. To make the extension direction of the reinforcing fiber of an outer-layer prepreg coincident with the longitudinal direction of the specimen, each prepreg is cut to a length of 30 mm and a width of 5 mm. Both ends of the specimen in its longitudinal direction are chucked in a length of 5 mm to measure the loss factor (=tan δ) in a length of 20 mm of a displaced portion thereof. The loss factor (=tan δ) of the second prepreg is measured by using a specimen formed by a method similar to the above-described method.

The reason the temperature is set to 0° C. to 10° C. is attributed to the rule of thumb of measurement of viscoelasticity, namely, a frequency-temperature conversion rule. In the rule of thumb, it is considered that one order of frequency corresponds to 10° C. The frequency of the primary out-of-plane vibration of the racket frame is about 100 to 200 Hz. The frequency of the secondary out-of-plane vibration of the racket frame is about 400 to 500 Hz. The in-plane vibration of the racket frame is affected by the tension of strings and its frequency is about 300 to 800 Hz. Therefore attention is paid to 0° C. to 10° C. in consideration of the relationship between the room temperature at which the racket frame is used and the above-described frequency. The frequency of forced vibration of the racket frame generated when a racket hits a ball is considered to be in the range of 100 to 1000 Hz. Thus by setting the tan δ measured in the above-described temperature range, it is possible to efficiently suppress a force generated by an impact applied to the racket frame.

It is preferable that the weight of the second prepreg is set to not less than 1% nor more than 10% of the weight of the first prepregs constituting the first laminate.

By using a proper amount of the second prepreg, it is possible to improve the vibration-damping performance of the racket frame without deteriorating the strength and rigidity thereof.

Preferably, supposing that the overall thickness of the layer of fiber reinforced resin is 100%, the second prepreg is disposed in a thickness range not more than 20% at both sides of the central position of the overall thickness.

When an impact is applied to the racket frame, the biggest shearing force is generated in the above-specified thickness range. Thus by disposing the second prepreg having a high vibration-damping performance in the above-specified thickness range, it is possible to efficiently damp vibrations generated on the racket frame.

Not less than 50% and favorably 100% of the second prepreg should be disposed in the specified thickness range.

It is preferable to use a thermosetting resin as the resinous component of the second prepreg so that the racket frame has a high strength and a preferable moldability is obtained. It is possible to set the loss factor of the second prepreg to not less than 0.10 nor more than 0.50 by adding additives such as an activator, a liquid rubber or a softener that increase a dipole moment amount to the resinous component of the second prepreg. As the resinous component of the second prepreg, it is possible to use a thermoplastic resin or a mixture of the thermosetting resin and the thermosetting resin.

The thermosetting resin is used as the resinous component of the matrix resin of the first prepreg to prevent deterioration of the strength and rigidity of the racket frame.

It is preferable that the composition of the matrix resin of the second prepreg contains epoxy resin and one or more activators selected from compounds having benzotriazole groups and compounds having diphenyl acrylate groups. DL26 and DL30 produced by C.C.I. Inc. can be used as the composition of the matrix resin of the second prepreg.

By mixing the activator with the epoxy resin, the epoxy resin is softened. Thereby it is possible to enhance the loss factor of the composition of the matrix resin and increase the dipole moment amount thereof. When the activator is dispersed in the composition of the matrix resin and compatibilized therewith, in a normal state, electric charges of the positive and negative dipoles are attracted to each other and placed in a stable state, with the dipoles being electrically connected with the resin. When vibrations are applied to the composition of the matrix resin, the dipoles are displaced and separated from each other. Thereafter a restoring action of attracting the dipoles to each other works. At this time, the dipoles contact each other and high polymeric chains constituting the base of the resin. Thereby a large quantity of a vibration energy is converted into a thermal energy as a friction energy. Owing to the above-described action, the vibration energy can be absorbed.

It is preferable that the molecules of the epoxy resin which is used for the second prepreg have long chains and a small number of side chains. It is also preferable that the equivalent weight of the epoxy resin is 250 to 350 and that its molecular weight is 500 to 700. Because such an epoxy resin has a small number of crosslinking points, the epoxy resin is capable of softening the resinous composition and increasing the loss factor thereof.

A mixture of polypropylene-ether epoxy resin and G-glycidyl ether epoxy resin is particularly preferable. It is possible to use various epoxy resins in combination. The loss factor of the resinous composition can be adjusted in dependence on a mixing amount of the activator. It is preferable to mix 10 to 200 parts by weight of the activator with 100 parts by weight of the resinous component.

It is preferable that the kind of the resinous component of the matrix resin of the first prepreg is the same as that of the second prepreg. It is preferable that the epoxy resin of the first prepreg has a smaller equivalent weight and a smaller molecular weight than the epoxy resin of the second prepreg. For example, a bisphenol A-type epoxy resin is preferable. Various additives may be added to the matrix resin of the first prepreg.

It is favorable that the tensile modulus of elasticity of a reinforcing fiber of the first prepreg and the second prepreg is set to not less than 150 GPa nor more than 600 GPa.

If the tensile modulus of elasticity of the reinforcing fiber of the second prepreg is less than 150 GPa, the rigidity of the racket frame deteriorates and its restitution performance is liable to deteriorate. The tensile modulus of elasticity of the reinforcing fiber of the second prepreg is set to more favorably not less than 200 GPa and most favorably not less than 250 GPa. If the tensile modulus of elasticity of the reinforcing fiber of the second prepreg is more than 600 GPa, the racket frame is liable to have a low resistance to shock. The tensile modulus of elasticity of the reinforcing fiber of the second prepreg is set to more favorably not more than 500 GPa and most favorably not more than 450 GPa.

It is preferable that the fiber content of each of the first prepreg and the second prepreg is set to the range of 45 to 60%. If the fiber content thereof is less than 45%, the rigidity of the racket frame is liable to deteriorate. On the other hand, if the fiber content thereof is more than 60%, the racket frame is liable to have a low resistance to shock. The fiber content means the ratio of the volume of the fiber in the prepreg to the entire volume of the prepreg.

It is preferable that the racket frame includes a head part forming the outline of a ball-hitting face thereof and a bifurcated throat part connected to the head part. Supposing that the ball-hitting face is regarded as a clock surface and that the top position of the ball-hitting face is 12 o'clock, the second prepreg is disposed at one position or two or more positions selected from among a first position in the range of 11 o'clock to one o'clock, a second position in the range of three o'clock to five o'clock (nine o'clock to seven o'clock), and a third position disposed at the left and right throat parts.

It is possible to improve the vibration-damping performance of the racket frame efficiently by disposing the second prepreg at the above-described position or positions where vibrations in each of the primary out-of-plane vibration mode and the secondary out-of-plane vibration mode are excited to the highest extent.

In terms of the racket-handling performance and the balance of the racket, it is preferable to dispose the second prepreg at positions symmetrical in the left-to-right direction of the racket frame. It is preferable that the second prepreg is disposed on the entire circumference of the racket frame in a sectional view thereof. The second prepreg may be disposed partly or intermittently at a plurality of positions of the circumference of the racket frame.

It is favorable that the length of the second prepreg in the axial direction of the racket frame is not less than 30 mm nor more than 90 mm.

If the length of the second prepreg in the axial direction of the racket frame is less than 30 mm, it is impossible to improve the vibration-damping performance of the racket frame sufficiently. The length of the second prepreg in the axial direction of the racket frame is more favorably not less than 40 mm and most favorably not less than 50 mm. If the length of the second prepreg in the axial direction of the racket frame is more than 90 mm, the racket frame has a low strength and rigidity. The length of the second prepreg in the axial direction of the racket frame is more favorably not more than 80 mm and most favorably not more than 70 mm.

As the reinforcing fiber, fibers which are used as high-performance reinforcing fibers can be used. For example, it is possible to use carbon fiber, graphite fiber, aramid fiber, silicon carbide fiber, alumina fiber, boron fiber, glass fiber, aromatic polyamide fiber, aromatic polyester fiber, ultra-high-molecular-weight polyethylene fiber, and the like. Metal fibers may be used as the reinforcing fiber. These reinforcing fibers can be used in the form of both long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics (cloth), braids, and the like.

Carbon fiber is preferable as the reinforcing fiber of the second prepreg, because the carbon fiber has a high strength and a low specific gravity. It is preferable that the carbon fiber is used at favorably not less than 50%, more favorably not less than 75%, and most favorably 100% of a layer of the fiber reinforced resin.

The racket frame of the present invention is suitably used for a racket of regulation-ball tennis having a weight not less than 180 g nor more than 305 g. In addition, the racket frame of the present invention is suitably used for a racket of softball tennis, badminton, and squash.

To harden the thermosetting resin such as the epoxy resin or the like, it is preferable to add an activator and a hardening agent thereto and heat a mixture to compatibilize the activator with the thermosetting resin.

In addition, the following agents may be added to the thermosetting resin as necessary: setting-accelerating agent, plasticizer, stabilizer, emulsifying agent, filler, reinforcing agent, colorant, foaming agent, antioxidant, ultraviolet prevention agent, and lubricant.

The racket frame of the present invention is formed by the following method:

Carbon fibers are wound around a drum at predetermined fibrous angles with the carbon fibers kept immersed in the composition of the matrix resin containing epoxy resin as its main component. After a predetermined amount of the carbon fibers is wound around the drum, an extra portion thereof is cut off. Thereafter the carbon fibers impregnated with the resin are heated at 80° C. to 100° C. to form prepregs in a pseudo-hardened state. The prepregs are cut with the prepregs layered one upon another at predetermined fibrous angles. After a mandrel having a certain diameter is inserted into a tube made of nylon or silicon, the prepregs are wound on the tube at predetermined positions respectively in such a way that the reinforcing fibers of the prepregs form predetermined angles and have predetermined fibrous amounts respectively. After the tube on which the prepregs have been wound are removed from the mandrel, the tube is set in a die for forming the racket frame. After an appropriate pressure is applied to the inside of the tube to contact the tube and the reinforcing fibers with the inner surface of the die, the die is heated at 150° C. for 15 minutes to harden the prepregs.

As apparent from the foregoing description, the racket frame of the present invention is composed of the first laminate composed of a plurality of first prepregs layered one upon another and the second prepreg layered on the first laminate. The first laminate has a loss factor (=tan δ) set to not less than 0.005 nor more than 0.02, when the loss factor is measured at a temperature of 0° C. to 10° C. and a frequency of 10 Hz. The second prepreg has a loss factor (=tan δ) set to not less than 0.10 nor more than 0.50, when the loss factor is measured at a temperature of 10° C. and a frequency of 10 Hz. The loss factors of the first laminate and that of the second prepreg layered on the first laminate are different from each other. Therefore it is possible to maintain the strength and rigidity of the racket frame owing to the use of the first laminate having the lower loss factor and enhance the vibration-damping performance thereof efficiently owing to the use of the second prepreg having the higher loss factor.

Merely the layer of the fiber reinforced resin is capable of improving the vibration damping performance of the racket frame without disposing a material such as a vibration-damping material in the layer of the fiber reinforced resin. Therefore it is possible to make the racket frame lightweight and use the racket frame suitably for various rackets such as a racket for regulation-ball tennis.

DETAILED DESCRIPTION OF THE PREFERRED EMBODIMENTS

The embodiments of the present invention will be described below with reference to the drawings.

Figure 1:
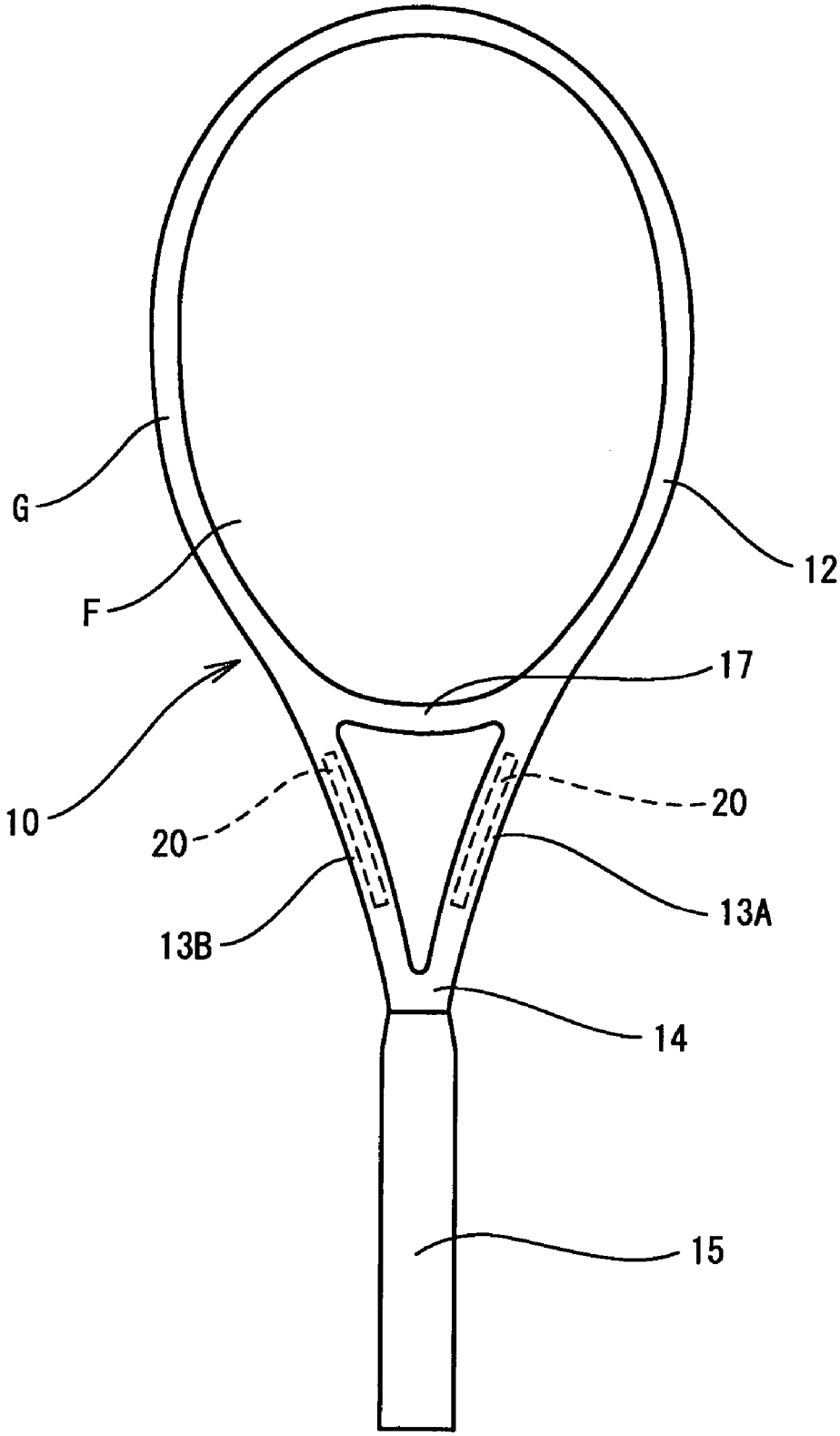
FIG. 1 is a schematic front view showing a racket frame of the present invention.

FIGS. 1 and 2 show a racket frame 10 according to an embodiment of the present invention.

The racket frame 10 is composed of a hollow pipe-shaped laminate of prepregs consisting of a fiber reinforced resin. As shown in FIG. 1, the racket frame 10 has a head part 12 forming the outline of a ball-hitting face F, bifurcated throat parts 13A, 13B connected to the head part 12, a shaft part 14, and a grip part 15. These parts 12, 13A, 13B, 14, and 15 are integrally formed. One end of a yoke 17 is connected to the throat part 13A, and the other end thereof is connected to the throat part 13B so that the yoke 17 and the head part 12 form a string-stretching part G surrounding the ball-hitting face F. String-stretching string holes (not shown in the drawings) are formed on the string-stretching part G.

In this embodiment, as shown in FIG. 2, in the left and right throat parts 13A and 13B, a second prepreg 20 is interposed between first laminate 30 (30-1 and 30-2) composed of first prepregs.

The second prepreg 20 has a loss factor (=tan δ) set to 0.3. The first laminate 30 has a loss factor (=tan δ) set to 0.01.

The above-described loss factor (=tan δ) of the first laminate is measured in a flexing mode and under the following conditions: a frequency set to 10 Hz, a temperature set to 10° C., a temperature increase set to 4° C., and a displacement amplitude set to ±50μ. A specimen used for the measurement is a laminate of nine layers of prepregs laminated one upon another, with reinforcing fibers of adjacent prepregs intersecting perpendicularly to each other. To make the extension direction of the reinforcing fiber of an outer-layer prepreg coincident with the longitudinal direction of the specimen, each prepreg is cut to a length of 30 mm and a width of 5 mm. Both ends of the specimen in its longitudinal direction are chucked in a length of 5 mm to measure the loss factor (=tan δ) of the first laminate in a length of 20 mm of a displaced portion thereof. The loss factor (=tan δ) of the second prepreg 20 is measured by using a specimen formed by a method similar to the above-described method.

The weight of the second prepreg 20 is set to 2 g which is 1% of the weight of the first prepreg. The length of the second prepreg 20 in the axial direction of the racket frame 10 is set to 60 mm.

In the position where the second prepreg 20 is disposed, the first laminate 30 is formed by layering 10 first prepregs one upon another. One second prepreg 20 is interposed between a fourth layer of the first laminate 30 and a fifth layer thereof.

Figure 2A:
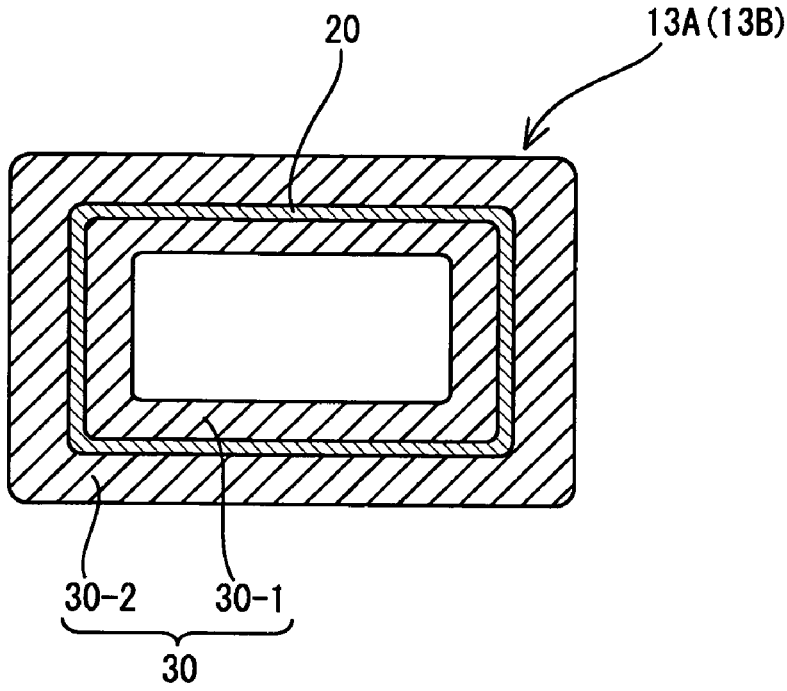
FIG. 2A is a sectional view showing a throat part in which a second prepreg is layered on a first laminate.
Figure 2B:
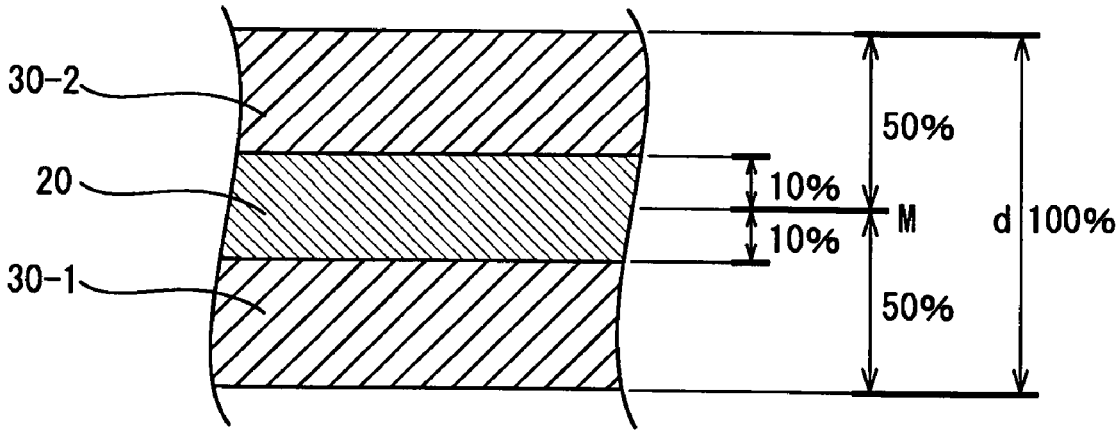
FIG. 2B is an explanatory view showing a layered situation of the second prepreg.

More specifically, the first laminate 30 is composed of an inner first laminate 30-1 and an outer first laminate 30-2, with the second prepreg 20 interposed between the inner first laminate 30-1 and the outer first laminate 30-2. The second prepreg 20 is so disposed as to make the thickness of the inner first laminate 30-1 almost equal to that of the outer first laminate 30-2. As shown in FIG. 2B, supposing that the overall thickness d of the layer of the fiber reinforced resin is 100%, the second prepreg 20 is disposed in a thickness range not more than 10% at both sides of a central position M of the overall thickness d. As shown in FIG. 2A, the second prepreg 20 is disposed on the entire circumference of the racket frame 10 in a sectional view thereof.

Carbon fibers having a tensile modulus of elasticity set to 200 to 500 GPa are used as the reinforcing fiber of the second prepreg 20 and the first prepreg constructing the first laminate 30. In this embodiment, carbon fibers having a tensile modulus of elasticity set to 390 GPa are used as the reinforcing fiber. The orientation angles of the reinforcing fibers with respect to the axis of the pipe-shaped laminate composing the racket frame 10 are set to 0°, 90°, 30 °, 22°, and 45°.

It is preferable that the fiber content of the first prepreg and that of the second prepreg 20 are set to 45 to 60%. In this embodiment, the fiber content of the first prepreg and that of the second prepreg 20 are set to equally 55%.

The composition of the matrix resin of the second prepreg 20 contains an epoxy resin and one or more activators selected from compounds having benzotriazole groups and compounds having diphenyl acrylate groups. More specifically, an epoxy resin formed by mixing polypropylene-ether epoxy resin with G-glycidyl ether epoxy resin is used as the composition of the matrix resin of the second prepreg 20. The epoxy resin has 296 in its tensile modulus of elasticity and 592 in its molecular weight.

Bisphenol A-type epoxy resin is used as the resinous component of the composition of the matrix resin of the first prepreg. The bisphenol A-type epoxy resin has 190 to 200 in its epoxy equivalent weight and 380 to 400 in its molecular weight. The composition of the matrix resin of the first prepreg contains no activators.

The method of forming the racket frame 10 from the second prepreg 20 and the first laminate 30 is described below.

Carbon fibers are wound around a drum at predetermined fibrous angles, with the carbon fibers kept immersed in the composition of the matrix resin of the first and second prepregs. After a predetermined amount of the carbon fibers is wound around the drum, an extra portion thereof is cut off. Thereafter the carbon fibers are heated at 80° C. to 100° C. to form the first and second prepregs in a pseudo-hardened state. The first and second prepregs are cut with the first and second prepregs layered one upon another at predetermined fibrous angles.

After a mandrel is inserted into a tube made of nylon, the first and second prepregs are wound around the tube at predetermined layering positions respectively in such a way that the reinforcing fibers of the first and second prepregs form predetermined angles and have predetermined fibrous amounts respectively. After the tube on which the first and second prepregs have been wound are removed from the mandrel, the tube on which the first and second prepregs have been wound is set in a die for forming the racket frame. After an appropriate pressure is applied to the inside of the tube to contact the tube and the reinforcing fibers with the inner surface of the die, the die is heated at 150° for 15 minutes to harden the first and second prepregs. In this manner, the racket frame 10 is formed.

In each of the left and right throat parts 13A, 13B of the racket frame 10, the second prepreg 20 whose loss factor (=tan δ) is set to 0.3. is disposed between the inner first laminate 30-1 and the outer first laminate 30-2. The weight of the second prepreg 20 is set to 1% of that of the first laminate 30, composed of the first prepregs, whose loss factor (=tan δ) is set to 0.01. Therefore it is possible to make the racket frame lightweight owing to the use of the fiber reinforced resin, make the racket frame rigid owing to the use of the reinforcing fibers, and enhance the vibration-damping performance of the racket frame efficiently without deteriorating strength thereof.

Figure 3:
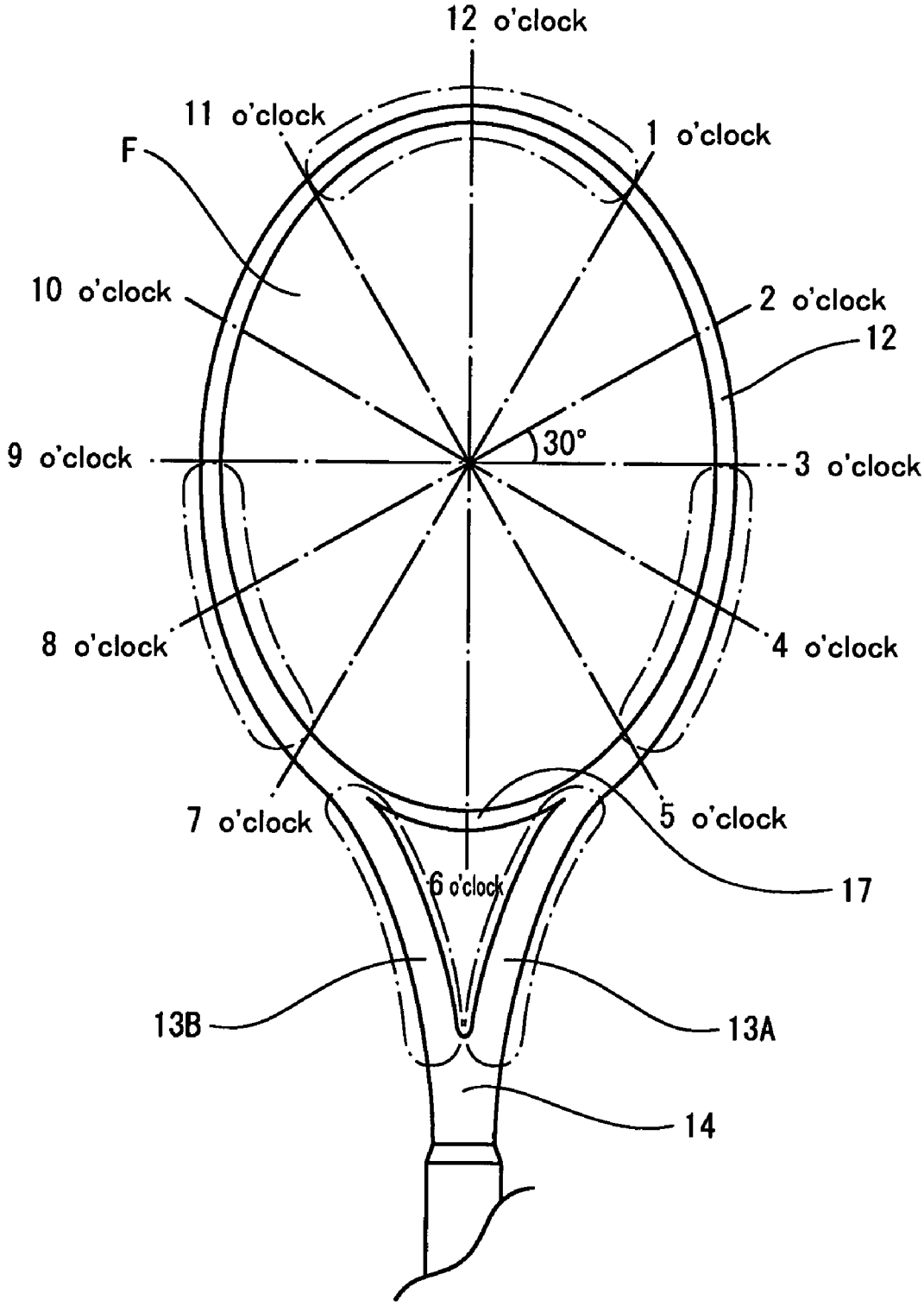
FIG. 3 shows positions where the second prepregs are disposed.

The disposition of the second prepreg 20 is not limited to the left and right throat parts 13A, 13B. As shown in FIG. 3, supposing that the ball-hitting face F is regarded as a clock surface and that the top position of the ball-hitting face F is 12 o'clock, it is possible to dispose the second prepreg 20 at one position or two or more positions selected from among a first position in the range of 11 o'clock to one o'clock, a second position in the range of three o'clock to five o'clock (nine o'clock to seven o'clock), and a third position disposed at the left and right throat parts.

Figure 4:
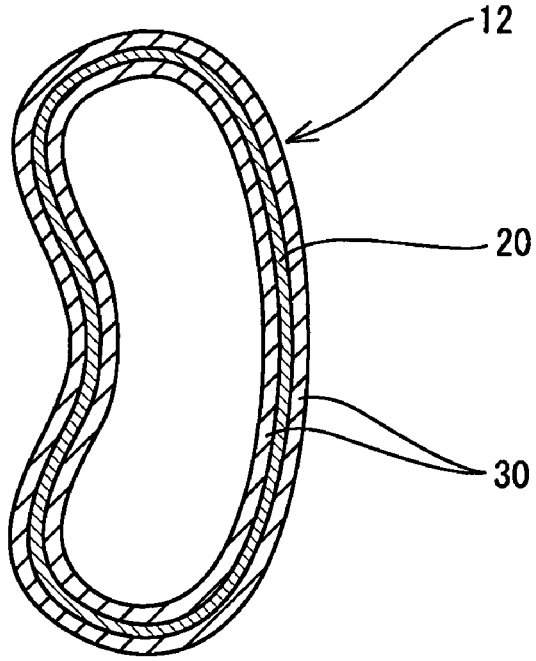
FIG. 4 is a sectional view showing a head part of the racket frame in which the second prepreg is layered on the first laminate.

The second prepreg 20 may be disposed at positions other than the above-described positions. In addition to the throat part, as shown in FIG. 4, the second prepreg 20 can be disposed at a four o'clock position included in the head part 12 where strings are stretched by interposing the second prepreg 20 between the adjacent first laminates 30.

Figure 5:
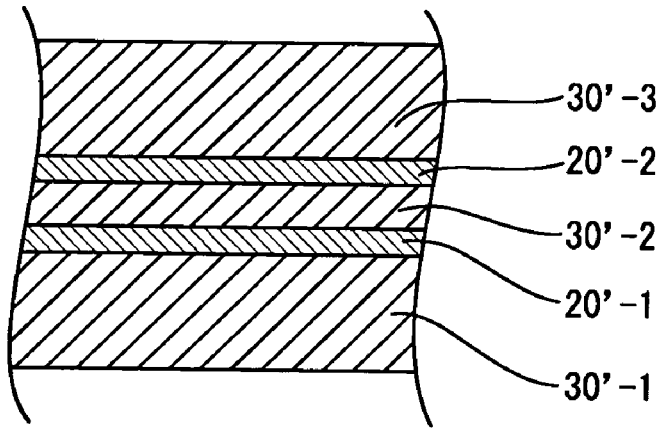
FIG. 5 shows a mode in which two second prepregs are layered on the first laminate.

As shown in FIG. 5, the first and second prepregs can be disposed by alternating two second prepregs 20'-1, 20'-2 and three first laminates 30'-1, 30'-2, and 30'-3 with each other. In addition, three or more second prepregs can be used.

The loss factor of the second prepreg can be adjusted in dependence on the kind of resin and additives such as an activator, a liquid rubber, a softener, and the like. It is also possible to set the configuration, thickness, and number of turns of the prepreg appropriately.

The examples of the racket frames of the present invention and comparison examples will be described in detail below.

The racket frame of each of the examples and the comparison examples was made of fiber reinforced resin and hollow. A racket composed of each racket frame had an overall length of 27.5 inches, a maximum thickness of 24 mm, a width of 12 mm, and a ball-hitting area of 110 square inches. The racket frames were formed by the method described below.

Prepreg sheets (CF prepreg (T300, T700, T800, M46J manufactured by Toray Industries Inc.) composed of a thermosetting resin reinforced with carbon fibers were layered one upon another on a mandrel (ϕ14.5 mm) on which an internal-pressure tube made of nylon 66 was fitted. Thereby a cylindrical laminate was formed. The prepreg sheets were layered one upon another at angles of 0°, 22°, 30°, and 90°. After the mandrel was removed from the laminate, the laminate was set in a die. After the die was clamped, the die was heated to 150° C. for 30 minutes, with an air pressure of 9 kgf/cm$^2$ kept applied to the inside of the inner-pressure tube.

The weight (mass obtained by excluding the weight of string) and the balance are set as shown in table 1.

TABLE 1

| | | Example 1 | Example 2 | Example 3 | Example 4 |
|---|---|---|---|---|---|
| Modified resin | Tanδ of first laminate (measured at 10° C. and 10 Hz) | 0.01 | 0.01 | 0.01 | 0.01 |
| | Tanδ of second prepreg (measured at 10° C. and 10 Hz) | 0.3 | 0.3 | 0.3 | 0.3 |
| | Weight(g) | 2 | 2 | 2 | 6 |
| | Ratio (%) of ② to ① | 1 | 1 | 1 | 3 |
| | Number of first prepregs of first laminate | 10 | 10 | 10 | 10 |
| | Layered position of second prepreg (Values in parentheses indicate | Between 4th and 5th layers(10%) | Between 4th and 5th layers(10%) | Between 4th and 5th layers(10%) | Between 3rd and 4th layers(20%) Between 4th and 5th layers(10%) Between 5th and 6th layers(0%) |

TABLE 1-continued

| | | | | | | |
|---|---|---|---|---|---|---|
| | distance from center of thickness) | | | | | |
| | Inserted position | | Throat | 4 o'clock | Top | Throat |
| | Weight(g)/balance(mm) | | 267/335 | 267/336 | 267/338 | 265/335 |
| Rigidity | Ball-hitting face/side pressure(kg/cm) | | 180/90 | 178/89 | 177/88 | 175/86 |
| Vibration | Primary out-of-plane | Frequency | 212 | 212 | 211 | 213 |
| | | Vibration-damping factor | 0.63 | 0.75 | 0.81 | 1.35 |
| | Secondary out-of-plane | Frequency | 555 | 554 | 558 | 556 |
| | | Vibration-damping factor | 0.72 | 0.71 | 0.70 | 1.23 |
| | Durability test | | ○ | ○ | ○ | ○ |
| | Evaluation of vibration-absorbing performance examined by hitting ball | | 3.9 | 3.9 | 3.9 | 4.2 |

| | | Example 5 | Example 6 | Example 7 | Example 8 |
|---|---|---|---|---|---|
| Modified resin | Tanδ of first laminate (measured at 10° C. and 10 Hz) | 0.01 | 0.01 | 0.01 | 0.01 |
| | Tanδ of second prepreg (measured at 10° C. and 10 Hz) | 0.3 | 0.3 | 0.1 | 0.5 |
| | Weight(g) | 4 | 20 | 2 | 2 |
| | Ratio (%) of ② to ① | 2 | 10 | 1 | 1 |
| | Number of first prepregs of first laminate | 10 | 10 | 10 | 10 |
| | Layered position of second prepreg (Values in parentheses indicate distance from center of thickness) | Between 4th and 5th layers(10%) | Between 4th and 5th layers(10%) | Between 4th and 5th layers(10%) | Between 4th and 5th layers(10%) |
| | Inserted position | 4 o'clock, throat | Top to throat | Throat | Throat |
| | Weight(g)/balance(mm) | 269/337 | 385/340 | 267/335 | 267/335 |
| Rigidity | Ball-hitting face/side pressure(kg/cm) | 176/87 | 174/85 | 180/90 | 180/90 |
| Vibration | Primary out-of-plane Frequency | 211 | 211 | 213 | 214 |
| | Vibration-damping factor | 0.86 | 2.51 | 0.50 | 0.73 |
| | Secondary out-of-plane Frequency | 555 | 554 | 555 | 554 |
| | Vibration-damping factor | 0.84 | 2.68 | 0.50 | 0.79 |
| | Durability test | ○ | ○ | ○ | ○ |
| | Evaluation of vibration-absorbing performance examined by hitting ball | 4.0 | 4.6 | 3.0 | 4.0 |

| | | Example 9 | Example 10 |
|---|---|---|---|
| Modified resin | Tanδ of first laminate (measured at 10° C. and 10 Hz) | 0.005 | 0.02 |
| | Tanδ of second prepreg (measured at 10° C. and 10 Hz) | 0.3 | 0.3 |
| | Weight(g) | 2 | 2 |
| | Ratio (%) of ② to ① | 1 | 1 |
| | Number of first prepregs of first laminate | 10 | 10 |
| | Layered position of second prepreg (Values in parentheses indicate distance from center of thickness) | Between 4th and 5th layers (10%) | Between 4th and 5th layers (10%) |
| | Inserted position | Throat | Throat |
| | Weight(g)/balance(mm) | 267/335 | 267/335 |
| Rigidity | Ball-hitting face/side pressure(kg/cm) | 185/92 | 180/89 |
| Vibration | Primary out-of-plane Frequency | 215 | 213 |
| | Vibration-damping factor | 0.53 | 0.68 |
| | Secondary out-of-plane Frequency | 558 | 555 |
| | Vibration-damping factor | 0.65 | 0.78 |
| | Durability test | ○ | ○ |
| | Evaluation of vibration-absorbing performance examined by hitting ball | 3.3 | 4.0 |

| | | CE1 | CE2 | CE3 | CE4 | CE5 |
|---|---|---|---|---|---|---|
| Modified resin | Tanδ of first laminate (measured at 10° C. and 10 Hz) | 0.01 | 0.01 | 0.01 | 0.002 | 0.05 |
| | Tanδ of second prepreg (measured at 10° C. and 10 Hz) | — | 0.05 | 0.6 | 0.3 | 0.3 |
| | Weight(g) | — | 2 | 2 | 2 | 2 |
| | Ratio (%) of ② to ① | — | 1 | 1 | 1 | 1 |
| | Number of first prepregs of first laminate | 10 | 10 | 10 | 10 | 10 |

TABLE 1-continued

| | | | | | | | |
|---|---|---|---|---|---|---|---|
| | Layered position of second prepreg (Values in parentheses indicate distance from center of thickness) | | — | Between 4th and 5th layers(10%) | Between 4th and 5th layers(10%) | Between 4th and 5th layers(10%) | Between 4th and 5th layers(10%) |
| | Inserted position | | — | Throat | Throat | Throat | Throat |
| | Weight(g)/balance(mm) | | 265/335 | 267/335 | 268/334 | 267/336 | 267/335 |
| Rigidity | Ball-hitting face/side pressure(kg/cm) | | 180/90 | 180/90 | 180/87 | 188/93 | 180/89 |
| Vibration | Primary out-of-plane | Frequency | 214 | 213 | 211 | 216 | 211 |
| | | Vibration-damping factor | 0.31 | 0.32 | 0.92 | 0.31 | 0.78 |
| | Secondary out-of-plane | Frequency | 554 | 552 | 551 | 558 | 554 |
| | | Vibration-damping factor | 0.42 | 0.42 | 0.98 | 0.40 | 0.93 |
| | Durability test | | ○ | ○ | X | ○ | X |
| | Evaluation of vibration-absorbing performance examined by hitting ball | | 2.5 | 2.5 | 4.3 | 2.5 | 4.1 |

where CE denotes comparison example.

EXAMPLE 1

The specification of the racket frame of the example 1 was similar to that of the above-described embodiment.

Two grams of the second prepreg having dimensions of 6 cm×8 cm×0.2 mm and a loss factor of 0.3 was disposed at the left and right throat parts. One second prepreg was disposed between the first laminates having a loss factor set to 0.01. More specifically, the second prepreg was disposed between a fourth layer and a fifth layer of 10 prepregs composing the first laminate.

DL26 produced by C.C.I. Inc. was used as the composition of the matrix resin of the second prepreg. To produce DL26, polypropylene-ether epoxy resin and G-glycidyl ether epoxy resin were mixed with each other to form an epoxy resin. A compound having a benzotriazole group and one or more activators selected from compounds having diphenyl acrylate group were added to the epoxy resin.

The composition of the matrix resin of the first prepreg consisted of bisphenol A-type epoxy resin, a dicyandiamide curing agent, DCMU, and methyl ethyl ketone. As the bisphenol A-type epoxy resin, Epicoat 828 (130 PS in viscosity at 25° C.) produced by Japan Epoxy Resin Inc. was used. As the dicyandiamide curing agent, Epicure DICY50 produced by Japan Epoxy Resin Inc. was used. As the DCMU, Dironzol produced by Hodoya Kagaku Kogyo was used. As the methyl ethyl ketone, MEK produced by Shell Japan Inc. was used.

As the reinforcing fiber of the first and second prepregs, HR40, produced by Mitsubishi Rayon Inc., having a tensile modulus of elasticity of 390 Gpa was used. The fiber content of each of the first and second prepregs was set to 55%.

EXAMPLE 2

The second prepreg was disposed at the four o'clock position of the head part and the eight o'clock position thereof. To dispose the second prepreg at the four o'clock position means that the center of the second prepreg in the axial direction of the racket frame is disposed at the four o'clock position. The other specifications of the racket frame were similar to those of the example 1.

EXAMPLE 3

The second prepreg was disposed at the top position (12 o'clock) of the head part. The other specifications of the racket frame were similar to those of the example 1.

EXAMPLE 4

Three layers of the second prepregs were used. More specifically, the second prepregs were disposed between the third and fourth layers of 10 first prepregs composing the first laminate, between the fourth and fifth layers thereof, and between the fifth and sixth layers thereof. The total weight of the second prepregs was 6 g. The other specifications of the racket frame were similar to those of the example 1.

EXAMPLE 5

The second prepreg was disposed at the left and right throat parts, the four o'clock position of the head part, and the eight o'clock position thereof. The total weight of the second prepregs was 4 g. The other specifications of the racket frame were similar to those of the example 1.

EXAMPLE 6

The second prepreg was disposed in the range from the top position of the head part to each of the left and right throat parts. The total weight of the second prepregs was 20 g. The other specifications of the racket frame were similar to those of the example 1.

EXAMPLE 7

The loss factor (=tan δ) of the second prepreg was set to 0.1. The other specifications of the racket frame were similar to those of the example 1.

EXAMPLE 8

The loss factor (=tan δ) of the second prepreg was set to 0.5. The other specifications of the racket frame were similar to those of the example 1.

EXAMPLE 9

The loss factor (=tan δ) of the first laminate was set to 0.005. The other specifications of the racket frame were similar to those of the example 1.

EXAMPLE 10

The loss factor (=tan δ) of the first laminate was set to 0.02. The other specifications of the racket frame were similar to those of the example 1.

COMPARISON EXAMPLE 1

The second prepreg was not used, but 10 prepregs composing the first laminates were used. The other specifications of the racket frame were similar to those of the example 1.

COMPARISON EXAMPLE 2

Instead of the second prepreg of the example 1, two grams of the second prepreg having a loss factor of 0.05 was disposed at the left and right throat parts. The other specifications of the racket frame were similar to those of the example 1.

COMPARISON EXAMPLE 3

Instead of the second prepreg of the example 1, two grams of the second prepreg having a loss factor of 0.6 was disposed at the left and right throat parts. The other specifications of the racket frame were similar to those of the example 1.

COMPARISON EXAMPLE 4

Instead of the first laminate of the example 1, the first laminate having a loss factor of 0.002 was used.

COMPARISON EXAMPLE 5

Instead of the first laminate of the example 1, the first laminate having a loss factor of 0.05 was used.

The racket frame of each of the examples and the comparison examples was examined on the rigidity of its ball-hitting face, the rigidity of its side surface, its primary out-of-plane vibration-damping factor, and its secondary out-of-plane vibration-damping factor by a method described later. A durability test of each racket frame was conducted. Further, evaluation was made on vibration-absorbing performance of each racket frame by hitting balls with each racket.

Measurement of Rigidity of Ball-Hitting Plane

Figure 6A:
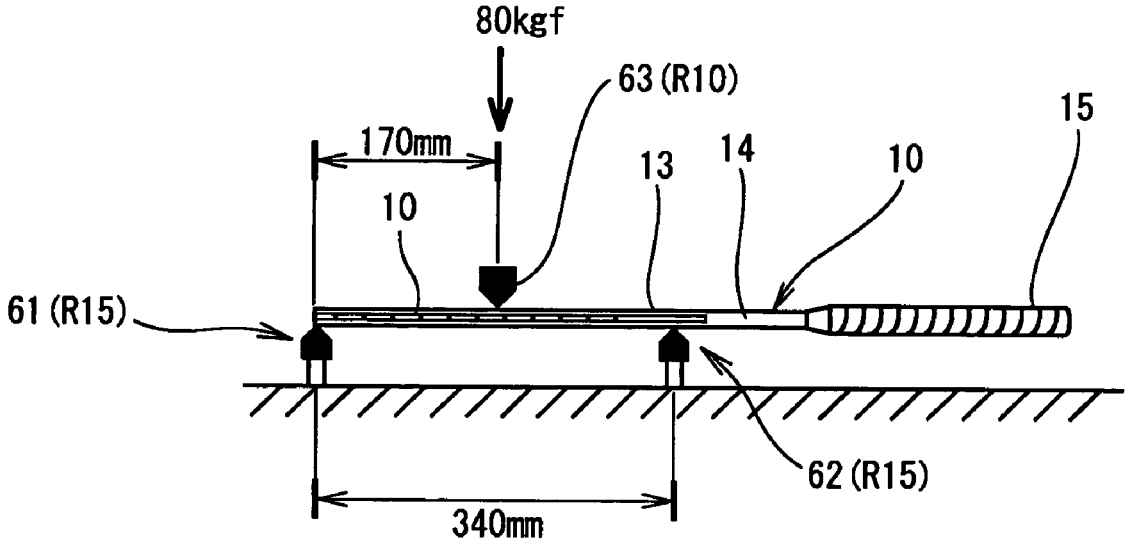
FIG. 6A is a schematic front view showing a method of measuring the rigidity of a ball-hitting plane.
Figure 6B:
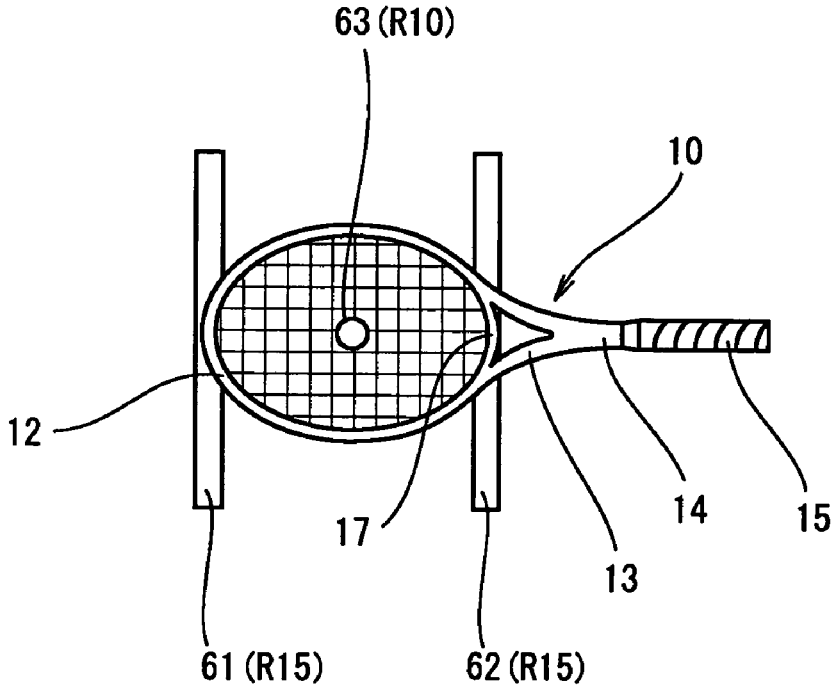
FIG. 6B is a schematic plan view showing the method of measuring the rigidity of the ball-hitting plane.

As shown in FIGS. 6A and 6B, strings were stretched on the racket frame 10 of each of the examples and the comparison examples and a racket composed of each racket frame 10 was horizontally disposed. The top position of the head part 12 was supported by a receiving jig 61 (R15). A position, spaced by 340 mm from the top position, which was located in the range between the throat part 13 and the yoke 14 was supported by a receiving jig 62 (R15). In this state, a load of 80 kgf was applied downward to a position spaced by 170 mm from the position of the jig 61 by means of a pressurizing instrument 63 (R10). The applied load of 80 kgf was divided by a displaced amount (flexed amount) of the ball-hitting plane to obtain the rigidity value thereof in the out-of-plane direction.

Measurement of Rigidity Value of Side Surface

Figure 7:
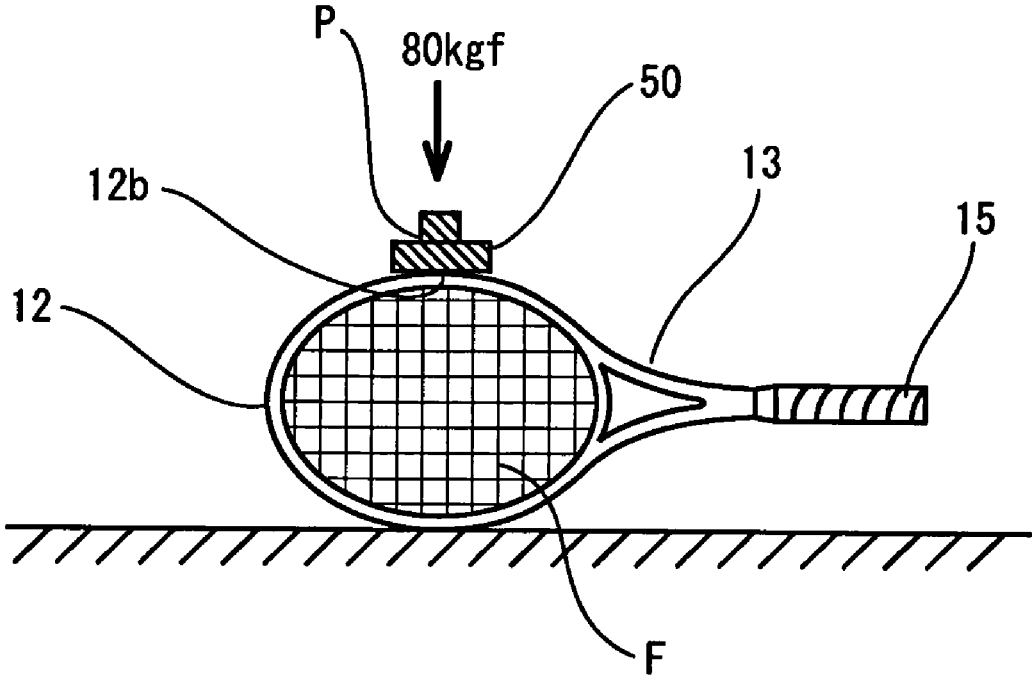
FIG. 7 is a schematic view showing a method of measuring the rigidity of a side surface of the racket frame.

As shown in FIG. 7, the tennis racket of each of the examples and the comparison examples was held sideways with a ball-hitting plane F kept vertical. In this state, a load of 80 kgf was applied to an upper side surface 12*b* of the head part 12 by means of a flat plate P. The applied load of 80 kgf was divided by a displaced amount (flexed amount) of the side surface 12*b* to obtain the rigidity value thereof in the in-plane direction.

Measurement of Primary Out-of-Plane Vibration Damping Factor

Figure 8A:
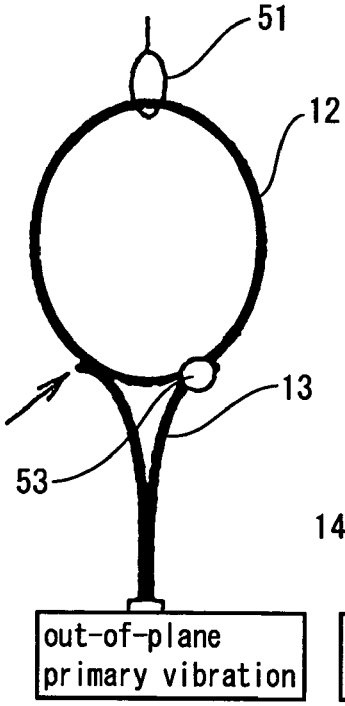
FIGS. 8A through 8C are schematic views showing the method of measuring the vibration-damping factor of the racket frame.

As shown in FIG. 8A, the upper end of the head part 12 of the tennis racket of each of the examples and the comparison examples was hung with a cord 51. An acceleration pick-up meter 53 was mounted on one connection portion between the head part 12 and the throat part 13, with the acceleration pick-up meter 53 disposed perpendicularly to the face of the racket frame. As shown in FIG. 8B, in this state, the other connection portion between the head part 12 and the throat part 13 was hit with an impact hammer 55 to vibrate the racket frame. An input vibration (F) measured by a force pick-up meter mounted on the impact hammer 55 and a response vibration (α) measured by the acceleration pick-up meter 53 were inputted to a frequency analyzer 57 (dynamic single analyzer HP3562A manufactured by Huret Packard Inc.) through amplifiers 56A and 56B. A transmission function in a frequency region obtained by the analysis was calculated to obtain the frequency of the tennis racket. The vibration-damping ratio (ζ) of the tennis racket, namely, the primary out-of-plane vibration-damping factor thereof was computed by an equation shown below. Table 1 shows the primary out-of-plane vibration-damping factor of the tennis racket of each of the examples and the comparison examples as the average value.

$$\zeta=(1/2)\times(\Delta\omega/\omega n)$$

$$To=Tn/\sqrt{2}$$

Measurement of Secondary Out-of-Plane Vibration-Damping Factor

Figure 8C:
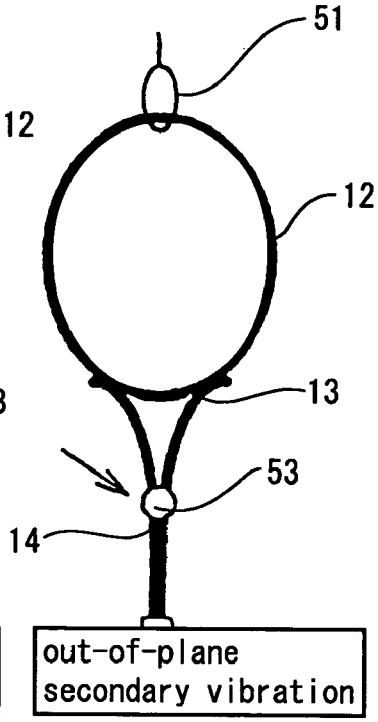
Figure 8B:
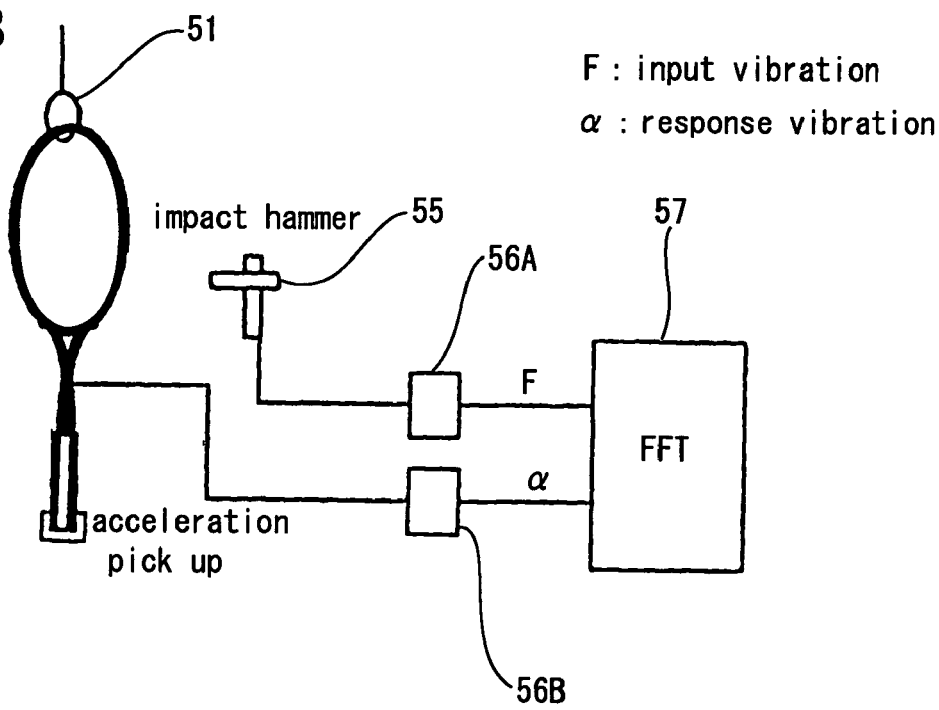

As shown in FIG. 8C, the upper end of the head part 12 of the tennis racket of each of the examples and the comparison examples was hung with the cord 51. The acceleration pick-up meter 53 was mounted on one connection portion between the throat part 13 and the shaft part 14, with the acceleration pick-up meter 53 disposed perpendicularly to the face of the racket frame. In this state, the rear side of a pick-up meter-installed position was hit with the impact hammer 55 to vibrate the tennis racket. The vibration-damping factor, namely, the secondary out-of-plane vibration-damping factor of the tennis racket was computed by a method equivalent to the method of computing the primary out-of-plane vibration-damping factor. Table 1 shows the secondary out-of-plane vibration-damping factor of the tennis racket of each of the examples and the comparison examples as the average value.

Durability Test

A ball was stricken against each racket frame at a position spaced by 18 cm from the top of the ball-hitting face thereof to check the durability thereof, namely, whether the racket frame was broken by an impact applied thereto.

Evaluation by Ball-Hitting Test

Questionnairing was conducted on the vibration-absorbing performance of each racket. Fifty middle and high class female players (who have not less than 10 year' experience in tennis and play tennis three or more days a week currently) hit balls with the rackets and gave marks on the basis of five (the more, the better). Table 1 shows the average of marks they gave.

The racket frame of each of the examples 1 through 10 was composed of the first laminate and the second prepreg layered on the first laminate. The loss factor of the first laminate was set to not less than 0.005 nor more than 0.02. The loss factor of the second prepreg s set to not less than 0.10 nor more than 0.50. As shown in table 1, it was confirmed that the racket frame of each of the examples 1 through 10 had high primary and secondary out-of-plane vibration-damping factors, was excellent in the evaluation of the ball-hitting test, and had an excellent vibration-damping performance without deteriorating the rigidity and strength thereof.

The racket frame of the comparison example 1 was composed of only the first laminate. The racket frame of the comparison example 2 was not composed of the second prepreg of the example 1 but composed of a layer of prepregs, consisting of fiber reinforced resin, having a loss factor set to less than 0.10. Therefore the racket frame of each of the comparison examples 1 and 2 had a low vibration-damping factor and was unfavorable in the evaluation of the ball-hitting test.

The racket frame of the comparison example 3 was not composed of the second prepreg of the example 1 but composed of the second prepreg whose loss factor was more than 0.5. Thus the racket frame had a high vibration-damping performance, but was unfavorably evaluated in the durability test.

The racket frame of the comparison example 4 was not composed of the first laminate of the example 1 but composed of the first laminate whose loss factor was less than 0.005. Thus the racket frame had a low vibration-damping performance and was unfavorably evaluated in the durability test.

The racket frame of the comparison example 5 was not composed of the first laminate of the example 1 but composed of the first laminate whose loss factor was more than 0.02. Thus the racket frame had a high vibration-damping performance but was unfavorably evaluated in the durability test.

What is claimed is:

1. A racket frame comprising a first laminate composed of a plurality of first prepregs consisting of fiber reinforced resin; and a second prepreg, consisting of fiber reinforced resin, which is layered on said first laminate, wherein said first laminate has a loss factor (=tan δ) set to not less than 0.005 nor more than 0.02, when said loss factor is measured at a temperature of 10° C. and a frequency of 10 Hz, and said second prepreg has a loss factor (=tan δ) set to not less than 0.10 nor more than 0.50, when said loss factor is measured at a temperature of 10° C. and a frequency of 10 Hz.

2. The racket frame according to claim 1, wherein a weight of said second prepreg is set to not less than 1% nor more than 10% of a weight of said first prepreg.

3. The racket frame according to claim 2, wherein supposing that an overall thickness of a layer of said fiber reinforced resin is 100%, said second prepreg is disposed in a thickness range not more than 20% at both sides of a central position of said thickness.

4. The racket frame according to claim 2, wherein a composition of a matrix resin of said second prepreg contains epoxy resin and one or more activators selected from compounds having benzotriazole groups and compounds having diphenyl acrylate groups; and a tensile modulus of elasticity of a reinforcing fiber of each of said first prepreg and said second prepreg is set to not less than 150 GPa nor more than 600 GPa.

5. The racket frame according to claim 2, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said second prepreg is disposed at one position or two or more positions selected from among a first position in a range of 11 o'clock to one o'clock, a second position in a range of three o'clock to five o'clock (nine o'clock to seven o'clock), and a third position disposed at said left and right throat parts.

6. The racket frame according to claim 1, wherein supposing that an overall thickness of a layer of said fiber reinforced resin is 100%, said second prepreg is disposed in a thickness range not more than 20% at both sides of a central position of said thickness.

7. The racket frame according to claim 6, wherein a composition of a matrix resin of said second prepreg contains epoxy resin and one or more activators selected from compounds having benzotriazole groups and compounds having diphenyl acrylate groups; and a tensile modulus of elasticity of a reinforcing fiber of each of said first prepreg and said second prepreg is set to not less than 150 GPa nor more than 600 GPa.

8. The racket frame according to claim 6, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said second prepreg is disposed at one position or two or more positions selected from among a first position in a range of 11 o'clock to one o'clock, a second position in a range of three o'clock to five o'clock (nine o'clock to seven o'clock), and a third position disposed at said left and right throat parts.

9. The racket frame according to claim 1, wherein a composition of a matrix resin of said second prepreg contains epoxy resin and one or more activators selected from compounds having benzotriazole groups and compounds having diphenyl acrylate groups; and a tensile modulus of elasticity of a reinforcing fiber of each of said first prepreg and said second prepreg is set to not less than 150 GPa nor more than 600 GPa.

10. The racket frame according to claim 1, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said second prepreg is disposed at one position or two or more positions selected from among a first position in a range of 11 o'clock to one o'clock, a second position in a range of three o'clock to five o'clock (nine o'clock to seven o'clock), and a third position disposed at said left and right throat parts.

* * * * *